United States Patent [19]

Jankowski

[11] 4,052,568

[45] Oct. 4, 1977

[54] DIGITAL VOICE SWITCH

[75] Inventor: Joseph Albin Jankowski, Bethesda, Md.

[73] Assignee: Communications Satellite Corporation, Washington, D.C.

[21] Appl. No.: 679,588

[22] Filed: Apr. 23, 1976

[51] Int. Cl.[2] ..... G10L 1/04

[52] U.S. Cl. ..... 179/15 AS

[58] Field of Search ..... 179/1 VC, 15 AS

[56] References Cited

U.S. PATENT DOCUMENTS

| | | | |
|---|---|---|---|
| 3,056,858 | 10/1962 | Milne | 179/15 AS |
| 3,520,999 | 7/1970 | May | 179/15 AS |
| 3,649,766 | 3/1972 | Lamarche | 179/15 AS |
| 3,706,091 | 12/1972 | May | 340/347 DD |
| 3,712,959 | 1/1973 | Fariello | 179/1 VC |
| 3,794,763 | 2/1974 | Boudewijns et al. | 179/1 VC |
| 3,801,747 | 4/1974 | Queffeulou et al. | 179/15 AS |
| 3,832,491 | 8/1974 | Sciulli | 179/1 VC |
| 3,832,493 | 8/1974 | Clark | 179/15 AS |
| 3,882,458 | 5/1975 | Hoeschele | 179/1 VC |

*Primary Examiner*—William C. Cooper

*Assistant Examiner*—Kenneth A. Chayt

*Attorney, Agent, or Firm*—Alan J. Kasper; Leo Millstein; John R. Berres

[57] ABSTRACT

A digital voice switch for detecting speech signals in the presence of noise on a communication channel. The voice switch employs a threshold adjustment circuitry and three threshold detectors which include a speech detector, a noise detector and a disabling detector. The speech detector having a variable speech threshold level detects the presence of speech signals in the communication channel. The noise detector having a variable noise threshold level detects the presence of noise. The threshold adjustment circuitry, which is capable of providing rapid threshold adjustment, operates in conjunction with the noise detector to detect the noise level and to adjust the speech and noise threshold levels according to the level of the noise present in the communication channel. The disabling detector having a fixed maximum threshold level operates to disable the function of the threshold adjustment circuit while speech is present.

5 Claims, 2 Drawing Figures

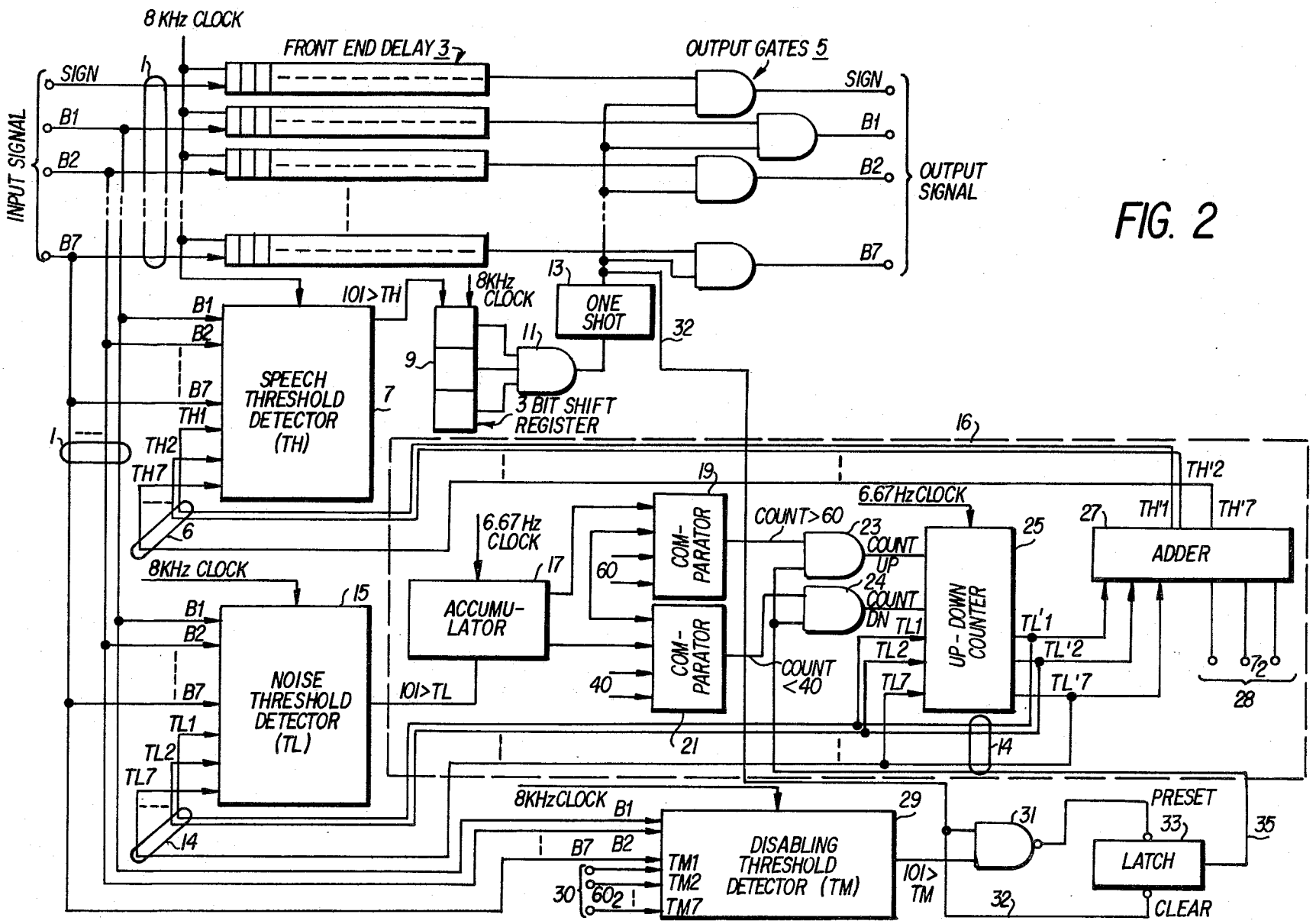
FIG. 2
OUTPUT SIGNAL
SIGN
B1
B2
B7
OUTPUT GATES 5
FRONT END DELAY 3
8 KHz CLOCK
INPUT SIGNAL
ONE SHOT
3 BIT SHIFT REGISTER
8KHz CLOCK
SPEECH THRESHOLD DETECTOR (TH)
NOISE THRESHOLD DETECTOR (TL)
ACCUMU-LATOR
6.67 Hz CLOCK
COM-PARATOR
COM-PARATOR
COUNT>60
COUNT <40
COUNT UP
COUNT DN
UP - DOWN COUNTER
6.67HzCLOCK
ADDER
LATCH
PRESET
CLEAR
DISABLING THRESHOLD DETECTOR (TM)
TM1
TM2
TM7
8KHzCLOCK
|01|>TH
|01|>TL
|01|> TM
TH1
TH2
TH7
TH'1
TH'2
TH'7
TL1
TL2
TL7
TL'1
TL'2
TL'7
60
40

DIGITAL VOICE SWITCH

BACKGROUND OF THE INVENTION

The present invention relates to a type of digital voice switch which is generally used in voice communication channels to detect speech in the presence of noise. In particular, the present invention relates to a digital voice switch which employs a speech detector having a variable speech threshold level, a noise detector having a variable noise threshold level, a disabling detector having a fixed maximum threshold level and a threshold adjustment circuitry which provides rapid adjustment of the speech and noise threshold levels.

Voice switches are known in the art as devices which distinguish between vocal sounds and noise carried by a communications channel. Devices of this nature have a number of known uses. For example, in a communication system which includes $n$ voice input channels and $m$ voice output channels, where $m<n$, voice switches are used to determine when there are vocal sounds on any of the $n$ input channels. Only those channels carrying vocal sounds at any instant are connected to an output channel. Clearly, the acceptable performance of the communication system depends upon the ability of the voice switches to recognize speech in the presence of noise and to establish and maintain a communications link between the input and output channels. A failure to detect speech signals may result in excessively long clipping of speech utterances and cause user dissatisfaction. Another important function of voice switches is to prevent noise signals from activating the communication channel during the silence intervals in speech so that optimum system loading may be achieved.

Previously known voice switches use various techniques to distinguish between noise and speech signals. The earliest and simplest prior art voice switches employ a detector having a fixed threshold level to compare digitally encoded samples of a signal on a channel with the fixed threshold level. If the samples of the signal are above the threshold level, it is assumed the signal represents voice. If the samples of the signal are equal to or below the threshold level, it is assumed that the signal represents noise. Typically, the voice detector detects speech by detecting a given number of consecutive samples in excess of the threshold value. Detection of four samples in sucession has been considered suitable.

Many vocal sounds result in a signal having an amplitude which tapers off toward the end of the sound. Should the amplitude fall below the threshold level, the described voice switch would be turned off before the completion of the sound and result in a clipped speech pattern. To prevent clipping of the trailing portion of transmitted sounds, the voice switch would be constructed to operate with a hangover time. For example, when speech is detected, the voice switch is turned on to pass the detected samples of the channel signal. Once turned on, the voice switch will remain on for a hangover period to insure passage of all samples of the sound. Typically, the prior art voice switches have a hangover time of 150 milliseconds.

Clipping of the front end of the speech segment may also occur because in certain vocal sounds the amplitude of the leading portion of the signal is low. To avoid front end clipping, all samples of the signal are delayed a fixed period of time, say 4 milliseconds, after the samples are received at the input of the voice switch to permit ample time for the detection of speech. After the delayed period, the samples are applied to the output of the voice switch which actually controls the passage of speech samples and the blockage of noise and other non-speech samples. Consequently, the voice switch would detect speech prior to the time the leading portion of the speech signal arrives at the output. Thus, clipping of the front end of the speech signal is minimized.

The described prior art threshold voice switches have many disadvantages. For example, because the amplitude of speech signals varies from speaker to speaker, the prior art voice switches cannot accurately distinguish the speech of low level talkers from channel noise. Moreover, the prior art switches may clip speech if the amplitude of the low level speech signals falls below the fixed threshold. The value of the threshold usually is set at a level which is a compromise between a high level, yielding minimum noise triggering, and a low level, yielding maximum speech detection. Another disadvantage exists because noise on a typical communication channel also varies over a considerable range and a high noise level could trigger the voice switch during the silence intervals in speech. The transmission of noise will use available channel capacity and increase system loading.

To overcome the shortcomings of the fixed threshold systems, voice switches having a variable threshold level have been introduced which adjust the threshold level to the correct level that yields maximum noise immunity and maximum sensitivity to speech. One such system is disclosed in U.S. Pat. No. 3,832,491 filed Aug. 27, 1974, issued to Joseph A. Sciulli et al. and assigned to the assignee of the present application. The invention discloses a voice switch having a digital adaptive threshold generating device. The threshold level is varied in accordance with the loudness of the talker by comparing the number of times the threshold is exceeded over a given period with a reference number. Maximum and minimum threshold levels are also provided to prevent the threshold level from rising too high when there is continuous talking by a loud talker and from falling too low when there is continuous silence.

Another type of prior art voice switches having a variable threshold is taught in the U.S. Patent application Ser. No. 606,828, filed Aug. 21, 1975, filed by Raymond H. Lanier and assigned to the assignee of the present invention. In the application of Lanier the threshold is shifted in response to changes in the noise level itself. This invention is based upon the recognition that over a given interval of time "T" speech will appear as random talk spurts separated by periods of silence, while noise (generally Gaussian distributed) will be continuous. This difference between speech and noise makes it possible to detect the noise level with respect to the voice switch threshold. To detect noise, a time interval T is divided in equal subintervals $\tau$. The number of samples that exceed the threshold in each subinterval is then counted. If the values of samples tend to be non-uniform over the interval T, then it is assumed that active speech is present. If, on the other hand, the values of samples tend to be uniform over the time interval T, then it is assumed that noise is present. In the latter case, when the number of samples accumulated during $\tau$ is large, the threshold level would be raised, whereas when the number of samples accumulated is small, the threshold level would be lowered. To maintain the threshold level just above the noise level, a threshold zone is provided wherein the zone is varied to cause the peak of the noise level to be above a minimum level of the zone but below a maximum level of the zone.

In the prior art variable threshold voice switches described above, the adjustment time initially required to increase or decrease the threshold level, and subsequently to vary the threshold level in response to a change in noise level, is relatively slow. The delay in system response resulting from these adjustments results in unsatisfactory switch performance. Another problem with the described systems is that the voice threshold level, when adjusted to uniform noise samples, is positioned too close to the noise level. Consequently, high noise pulses which are present in normal telephone line noise, quite often exceed the voice threshold level and cause false triggering of the voice switch.

SUMMARY OF THE INVENTION

The present invention relates to a variable threshold digital voice switch which detects speech signals in the presence of noise in communications channels. The present invention is designed to overcome the disadvantages of previously known voice switches by providing:

- a greater immunity to false detection of noise;
- a faster threshold adjustment in response to varying noise levels;
- a simplification in design; and
- a minimization of speech clipping.

The voice switch of the present invention employs three threshold detectors and a threshold adjustment circuitry. In particular, the voice switch provides a speech threshold detector having a high speech threshold level $T_H$ to detect the presence of speech, a noise threshold detector having a low noise threshold level $T_L$ to detect the presence of noise, a threshold adjustment circuitry operating in conjunction with the noise threshold detector to detect the noise level and to position $T_H$ and $T_L$ according to the noise level, and a disabling threshold detector having the maximum threshold level $T_M$ to disable the threshold adjustment circuitry when speech is present. The threshold levels of $T_H$ and $T_L$ are variable while the threshold level of $T_M$ is fixed. The threshold adjustment circuitry operates at a high speed and is capable of performing rapid adjustment of $T_H$ and $T_L$ in response to varying noise levels.

The voice switch of the present invention is designed to operate in a digital communications system which transmits voice signals in digital form. The voice signals are first sampled and encoded into digital form before they are applied to the input of the voice switch. The input samples are applied to a delay device which delays the application of the samples to the output of the voice switch for a fixed period of time. This delay provides a buffer against clipping of the front end of the speech burst and allows ample time for detection of speech.

The speech threshold detector having $T_H$ as the speech threshold level is provided to detect the presence of speech and operates as follows. The input samples, which are applied to the delay device, are also applied to the input of the speech detector and the magnitude of the samples is compared with the speech threshold level $T_H$. When three consecutive samples are detected to be greater in magnitude than $T_H$, speech is determined to be present. The three consecutive sample period, instead of the conventional four consecutive period, is utilized as the basic decision interval for detecting speech signals because experimentation has revealed that on any given speech waveform the speech threshold level for three consecutive sample detection would be positioned further above the noise level than the level for four consecutive sample detection without sacrificing any speech detection capability. This means that the present invention having a higher threshold level $T_H$ than the conventional systems would yield greater noise immunity. Upon detecting speech, the speech detector applies an output signal to the output of the voice switch and causes it to be turned on. When the voice switch is turned on, it will permit the passage of the speech samples which are delayed by the delay device. Once the voice switch is in the "on" state, it will remain on for a hangover period, which is set at a fixed period of time, approximately 170 milliseconds, to minimize clipping of the trailing portion of the speech burst. The hangover period is set only after the detection of the last three consecutive speech samples in a speech burst. Of course, for a long speech burst, the voice switch will remain on without interruption for so long as consecutive speech samples are detected in the speech detector.

The noise threshold detector having $T_L$ as the noise threshold level is provided to detect the presence of noise. The input samples, which are applied to the delay device and the input of the speech threshold detector, are also applied to the input of the noise detector. The magnitude of the samples is compared with the noise threshold level $T_L$. Each time the magnitude of a sample exceeds $T_L$, the noise detector produces an output signal representing the presence of noise. The threshold adjustment circuitry operates in conjunction with the noise detector to detect the noise level and to simultaneously adjust the speech and noise threshold levels according to the noise level. To accomplish the threshold adjustment, the output signals from the noise detector are accumulated over a given interval of time $i$. During the period of time $i$, the number of signals ($Ni$) is accumulated. If the accumulation $Ni$ is greater than a first predetermined percentage $x$ of the total number of samples, which indicates that $T_L$ is below the noise level, both $T_H$ and $T_L$ are increased by a fixed increment. $T_H$ is separated by a fixed distance $\Delta$ above $T_L$. If the accumulation $Ni$ is less than a second predetermined percentage $y$ of the samples, which indicates that $T_L$ is above the noise level, $T_H$ and $T_L$ are decreased by the same increment. In this manner the threshold levels $T_H$ and $T_L$ are adjusted until $Ni$ is within a desired range which is between $x\%$ and $y\%$ of the total number of samples during the sampling period of $i$. For example, a range between 3.3% and 5% is found to be suitable. At this range, $T_L$ is positioned near the noise level and $T_H$ is positioned just slightly above the noise level. At this position, the speech threshold level $T_H$ is far enough above the noise level to screen out most of the noise signals, yet low enough to detect low-level speech signals.

Since the noise level changes from time to time, the positions of $T_H$ and $T_L$ are constantly adjusted according to the changes in the noise level. Because the input samples are continuously applied to the input of the noise detector, the level of noise is periodically measured by accumulating over time $i$, the number of signals ($Ni$) which exceed the noise threshold level $T_L$. The positions of $T_H$ and $T_L$ are then adjusted accordingly until $Ni$ is within the desired range. At this range, $T_L$ and $T_H$ are again properly adjusted with respect to the new noise level.

The adjustment time required by the voice switch of the present invention for the initial adjustment when an idle channel becomes active or for the threshold levels to react to a change in noise is only dependent upon the time needed to detect the noise level and the time required to adjust $T_L$ and $T_H$ until $T_L$ is positioned near the noise level. Compared with the prior art variable threshold noise detectors, the adjustment circuitry of the present invention operates at a much faster rate and thus provides a better switching performance than the previously known detectors.

It is known that in a typical communications channel the noise appears punctuated by spurts of speech. During active speech, the speech samples that are applied to the input of the noise detector will greatly increase N*i* and will cause the thresholds to be misadjusted to high levels. To overcome the incorrect adjustments during the presence of speech, the disabling threshold detector having $T_M$ as the disabling threshold level is employed to disable the threshold adjustments of the $T_H$ and $T_L$ while speech is present. $T_M$ is fixed at a level which is high enough so that it will not be exceeded by typical noise level and yet is low enough so that it will be easily exceeded at least once during a speech burst. When $T_M$ is exceeded and the hangover is placed in an ON state due to detection by the speech threshold that three consecutive samples have exceeded $T_H$, all threshold level adjustments are disabled and will remain disabled for the entire duration of the hangover period.

BRIEF DESCRIPTION OF THE DRAWINGS

The specific nature of the invention, as well as other objects, aspects, uses, and advantages thereof, will clearly appear from the following description and from the accompanying drawing, in which:

FIG. 2 is a block diagram of the preferred embodiment of the present invention.

DESCRIPTION OF THE PREFERRED EMBODIMENT

Figure 1:
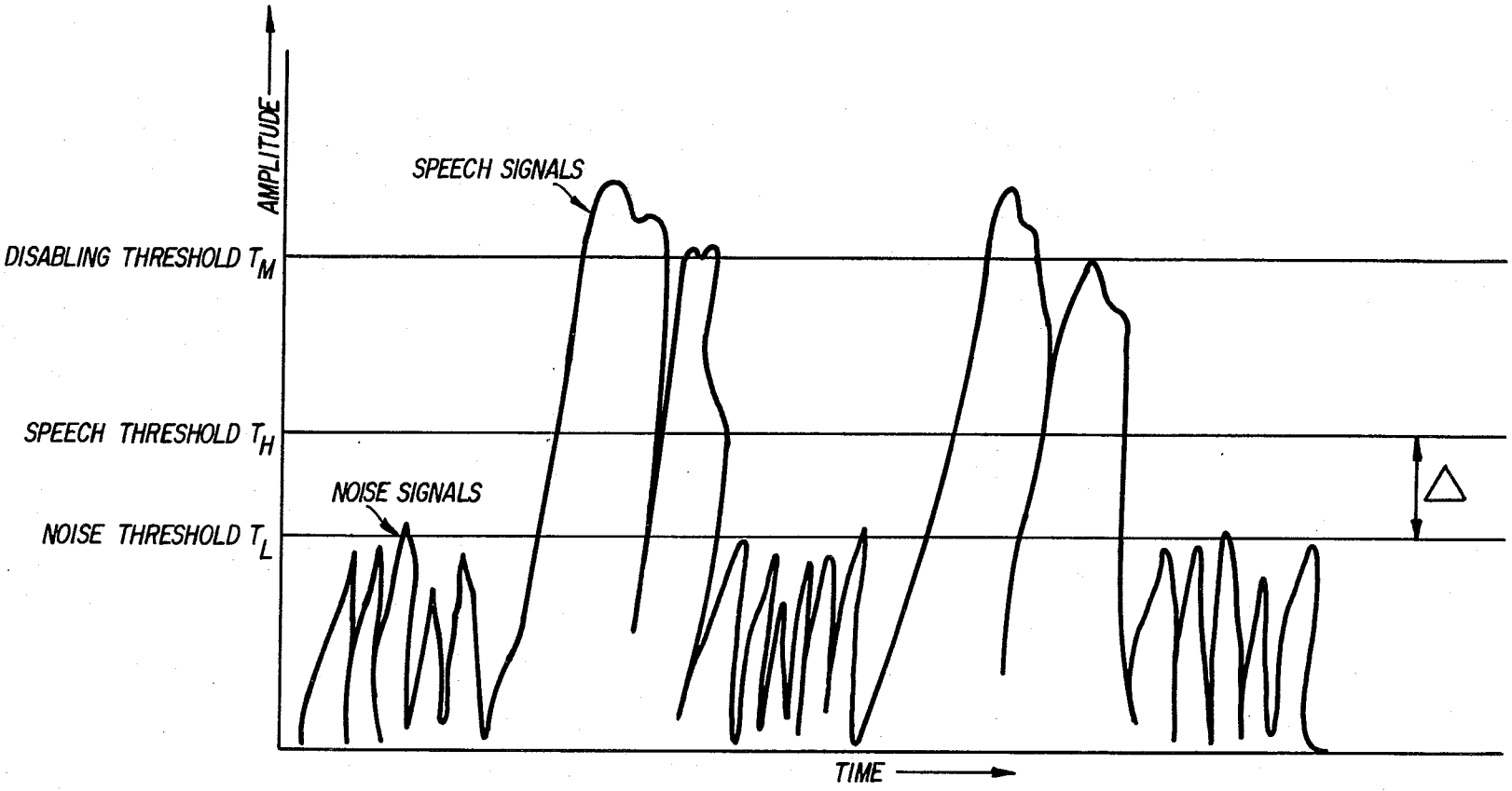
FIG. 1 is a graphical representation showing the positions of the speech threshold level $T_H$, the noise threshold level $T_L$ and the disabling threshold level $T_M$ with respect to the noise and speech levels.

The effectiveness of a voice switch is dependent upon the placement of a speech threshold level with respect to the speech and noise levels. Ideally, the speech threshold level should be positioned just above the noise level to maximize sensitivity to speech signals and remain immune to false triggering caused by high level noise signals. Since noise on a typical communication channel varies over a considerable range of levels, it also is critical to adjust the speech threshold level according to changes in noise level.

The voice switch of the present invention utilizes a speech detector having a variable speech threshold level $T_H$ to detect the presence of speech, a noise detector having a variable noise threshold level $T_L$ to detect the presence of noise, a threshold adjustment circuitry operating in conjunction with the noise detector to measure the noise level and to adjust the threshold levels $T_H$ and $T_L$ and a disabling detector having a fixed disabling threshold level $T_M$ to disable the adjustment circuitry when speech is present. An illustration of the positions of the speech threshold level $T_H$, the noise threshold level $T_L$ and the disabling threshold level $T_M$ with respect to the speech and noise levels is shown in FIG. 1. To position the level $T_H$ just above the noise level, it is necessary to periodically measure the noise level and correspondingly adjust $T_H$. As illustrated in FIG. 1, the speech threshold level $T_H$ is maintained at a fixed distance $\Delta$ above the noise threshold level $T_L$, where $T_H = T_L + \Delta$. (A preferred value for $\Delta$ for a particular code is given below; for example, for the code contemplated in the example described herein, a delta value corresponding to seven binary steps may be utilized.) To measure the noise level, the noise detector and the threshold adjustment circuitry are employed, wherein the number of samples N*i*, which exceed the variable noise threshold level $T_L$, is accumulated over a given interval of time *i*. A time interval of 150 milliseconds is determined to be sufficient. If N*i* is greater than say 5% of the total number of samples in the time interval, both $T_L$ and $T_H$ are increased by a step increment so that the number of samples above $T_L$ will be reduced. If N*i* is less than say 3.3% of the samples, the levels of $T_L$ and $T_H$ are similarly reduced thus causing an increase in the number of noise samples above $T_L$. The threshold levels are adjusted until N*i* falls within the range between 3.3% and 5% of the total number of samples or is approximately equal to 4% of the samples. When N*i* is approximately equal to 4% of the total number of the samples, the speech threshold $T_H$ is thus properly adjusted to the optimum position which is slightly above the noise level and yet low enough to detect low level speech signals.

The disabling threshold $T_M$ is also employed in the present invention to disable the threshold adjustment circuitry while speech is present. As shown in FIG. 1, $T_M$ is set to a fixed level, say −23dBmO, which is considerably above a typical line noise level and yet low enough to be exceeded at least once during a speech burst.

The preferred embodiment of the digital voice switch which accomplishes the foregoing results is illustrated in FIG. 2. As is conventional in a digital communications channel which transmits voice information in digital format, the analog voice information is applied to a conventional encoder wherein the analog signals are sampled, typically, at an 8-KHz rate, and subsequently encoded into an 8-bit digital sample. As well known in the art, the 8-bit samples comprising 7 amplitude bits and 1 sign bit are applied to the input of the digital voice switch. The 8-bit samples, indicated as SIGN, $B_1$, $B_2$, . . . , $B_7$, are applied in parallel by the input lines shown generally at 1. The switching portion of the digital voice switch comprises 8 parallel front end delay units, shown generally at 3, which consist of serial shift registers clocked at the sampling frequency of 8kHz.

The shift-registers of the front end delay 3 have a sufficient number of stages to provide a 4 millisecond delay to allow ample time for speech detection which will be explained below and thus provide a buffer against clipping of the leading portion of speech signals. The outputs of the delay units 3 are fed directly to output AND gates shown generally at 5. The output AND gates are turned on to pass voice samples when speech signals are present in the communication channel. The output gates are turned off to block the passage of non-voice or noise samples when non-voice signals are present in the channel.

The magnitude bits, $B_1$, $B_2$, . . . , $B_7$, of the input samples of lines 1 also are applied to a speech threshold detector 7. A digital representation, TH1 – TH7, of the threshold level, also is applied to the detector 7 by lines 6. Lines 6 are connected to and fed back from a portion of the threshold adjustment circuit which will be explained below. Since the threshold level will always be positive, it is not necessary to provide a sign bit for the digital threshold value. The speech threshold detector may consist of a conventional comparator constructed in a well known manner as an operational amplifier. The comparator digitally compares the magnitude of the sample represented by the signals in lines 1 with the magnitude of the speech threshold level represented by the signals in lines 6 (TH1 - TH7). The comparator in the speech detector generates a binary 1 output if the magnitude of the sample exceeds the threshold level and a binary 0 output if the magnitude of the sample is equal to or less than the threshold level. The binary outputs from the threshold detector 7 are clocked by an 8 kHz clock into a 3-bit shift serial register 9. When the shift register 9 is completely filled with three binary 1 bits indicating that three consecutive samples exceed the threshold level, the outputs of the shift register will be all binary 1 and will energize AND gate 11. Thereupon, the AND gate 11 applies a binary 1 output to the triggering input of a one-shot multivibrator 13. If the shift register 9 is not filled with all binary 1 bits, the AND gate 11 will not be energized indicating that speech is not present or is no longer present in the communication channel.

The one-shot 13 is a conventional retriggerable device having a fixed time pulse width which provides a hangover time. The hangover time may be set at a time period typically between 150 and 180 milliseconds. Thus, the output of the one-shot 13 will rise to its active level upon triggering and will drop to its non-active level say 170 milliseconds after the last received trigger. The active output of the one-shot device 13 energizes the output AND gates 5 to pass the delayed speech samples to the output terminal.

If the AND gate 11 is not energized because the speech detector fails to detect three consecutive samples exceeding the threshold level, the one-shot 13 will not be triggered to its active level and the output AND gates 5 will not be turned on. Consequently, the AND gates 5 will block the passage of the delayed non-voice samples.

If a long and high amplitude speech burst is present in the communication channel, all of the samples of the speech signal probably will exceed the speech threshold level and only consecutive binary 1 outputs will be generated by the speech detector 7. Thus, the shift register 9 will be continuously filled with binary 1 bits and the one-shot 13 will be in the active state for as long as speech is detected to be present in the channel. The output AND gates 5 will be turned on to pass the entire speech burst without any interruption and will remain on for the period of the hangover time after the detection of last three consecutive speech samples.

Except for the introduction of the 3-bit shift register 9 in place of the conventional 4-bit shift register, the voice switch described thus far is conventional. The major improvement provided by the subject invention is in the apparatus for adjusting the speech threshold level according to the changes in the noise level and in the device for disabling the threshold adjustment circuitry when speech is present.

To adjust the level of the speech threshold detector 7 according to the noise level in the input channels, the subject invention employs a noise threshold detector 15 and a threshold adjustment circuitry 16. As shown in FIG. 2, the magnitude bits, $B_1, B_2, \ldots, B_7$, of the input samples in lines 1 are simultaneously fed to the noise threshold detector 15 as well as to the speech threshold detector 7. The noise threshold detector 15 may consist of a conventional comparator constructed in a well known manner as an operational amplifier. The comparator compares the magnitude of the input samples in lines 1 with a noise threshold level indicated as TL1 - TL7 in lines 14, which are connected to and fed back from a portion of the threshold adjustment circuitry 16 which will be explained below. The comparator provides a binary 1 at its output if the input sample exceeds the threshold level and a binary 0 if the input sample is equal to or less than the threshold level. The threshold adjustment circuitry 16 is comprised of an accumulator 17, comparators 19 and 21, a counter 25 and an adder 27. The outputs from the noise threshold detector 15 are applied to the input terminal of the accumulator 17, which may be a conventional counter or shift register. The accumulator 17 counts the number of binary 1 outputs received from the noise detector 15 during a given period of time, say 150 milliseconds. The accumulator is reset to zero every 150 milliseconds by a 6.67 Hz clock signal. The output of the accumulator 17 is applied to the inputs of two comparators 19 and 21. Comparators 19 and 21 are conventional devices which compare the state of the accumulator 17 with preset numbers. In the specific example described, comparator 19 compares the accumulated number with a fixed number, 60, which represents 5% of the total number of samples in the 150-millisecond interval. If the accumulated number is greater than 60, the comparator output provides a binary 1 to one of two inputs of an AND gate 23. The other input to the AND gate 23 is connected to a latch 33 which performs the disabling function and will be explained below. When both inputs of the AND gate 23 receive binary 1 inputs, gate 23 is enabled and passes a binary 1 output to the count-up input of the up-down counter 25. Similarly, comparator 21 compares the accumulated number with a fixed number 40, which represents 3.3% of the total samples in the 150-millisecond interval. If the accumulated number is less than 40, comparator 21 provides a binary 1 output to one of two inputs of an AND gate 24. The other input to the AND gate 24 is connected to the latch 33 which will be explained below. When both inputs of the gate 24 receive binary 1 inputs, gate 24 is enabled and passes a binary 1 output to the count down input of the up-down counter 25. If neither of the two conditions is met or when the accumulation is $\geqq$ than 40 and $\leqq$ than 60, then gates 23 and 24 will not be enabled. When the latter condition occurs, it represents that the noise threshold level as indicated by signals in lines 14 is properly positioned with respect to the noise level and no adjustment is needed.

It will be appreciated from the foregoing that the count in the accumulator 17 is the number $Ni$ of the samples which exceed the noise threshold level, as indicated by signals in lines 14, in the time interval $i$. Although the time interval $i$ may be any desirable period of time, a time interval $i$ of 150 milliseconds is used as an example in explaining the preferred embodiment of the present invention. Comparators 19 and 21 determine whether the accumulation $Ni$ is in one of the three following ranges:

1st range: $Ni > 60$

2nd range: $Ni < 40$

3rd range: $40 \leqq N \leqq 60$

The first two ranges indicate that the noise threshold level is positioned either too low or too high, respectively, whereas the third range indicates that the threshold level is properly positioned with respect to the noise level.

After determining the relative position of the noise threshold level, appropriate adjustment to the noise threshold level in the noise detector 15 and speech threshold level in the speech detector 7 is carried out. If the count up or count down input of the up-down counter 25 is active during the 6.67 Hz clock pulse, which indicates that the accumulation N*i* is greater than 60 or less than 40, then the value of the noise threshold level, TL1 - TL7, applied at the input of the counter 25 is increased or decreased, respectively, by one quantization step in the binary form. The output of the up-down counter 25, which now contains the adjusted value, TL'1 - TL'7, of the noise threshold level, is applied to the input of the counter 25, to the input of the noise threshold detector 15 and to the input of an adder 27 by lines 14. As mentioned in the foregoing, the speech threshold level of the detector 7 is maintained at a fixed distance Δ above the noise threshold level and is adjusted simultaneously with the noise threshold level, the adder 27 is employed to carry out the aforementioned adjustment function. When the adjusted value of noise level, TL'1 - TL'7, is applied to the adder 27, a Δ value represented by seven binary steps is added thereto from lines 28 to generate a new speech threshold value TH'1 - TH'7. As shown in FIG. 2, the new TH'1 - TH'7 value is applied by the output of the adder 27 by lines 6 to the speech threshold detector 7 to adjust the speech threshold level to its optimum position, which is slightly above the noise level.

If the up-down counter 25 is inactive indicating that N*i* is in the third range and that the noise threshold level is properly positioned with respect to the noise level, no adjustments to the noise threshold level and speech threshold level is carried out.

To disable the speech and noise threshold adjustment circuitry while speech is present, a third disabling threshold detector 29 is employed. As illustrated in FIG. 2, the magnitude bits of the input samples on lines 1 are simultaneously fed to the disabling threshold detector 29, as well as to the speech threshold detector 7 and noise threshold detector 15. Another input to the disabling threshold detector 29 is connected to lines 30. Lines 30 are connected to a source of disabling signals which represents a fixed disabling threshold level. The disabling threshold level may be set at any desirable amplitude level which is high enough so that it is exceeded at least once during a speech burst. In the present invention, a level represented by the number 60 in binary form, which is equivalent to a threshold value of −23.0 dBmO, is found to be suitable. The disabling threshold detector 29 may consist of a conventional comparator, which is constructed in a well known manner as an operational amplifier. The comparator compares the magnitude of the input samples in lines 1 with the fixed threshold value in lines 30. When the magnitude bits of the input sample are determined to be greater than the threshold value, a binary 1 is applied to one input of a NAND gate 31. The NAND gate 31 is comprised of two inputs and one output. The other input to the NAND gate 31 is applied by line 32 from the one shot multivibrator 13 in the speech detection circuitry. If the input from the hangover one shot 13 is also active, then the NAND gate 31 applies an output of a binary 0 to the negative triggering preset input of a latch 33. If either the sample fails to exceed the disabling threshold level or the one-shot 13 is in the inactive state, or if both conditions exist, the NAND gate 31 applies an output of a binary 1 to the preset input of the latch 33. The latch 33 may consist of a conventional latch flip-flop or a latch switch comprising two negative triggering inputs. As shown in FIG. 2, the latch 33 contains preset and clear inputs. The latch is preset when a binary 0 from the output of the NAND gate 31 is applied at the preset input of the latch 33. The latch then outputs a binary 0 to the input of AND gates 23 and 24 of the threshold adjustment circuit 16 by means of an adjustment enable line 35. The application of binary 0 to the AND gates 23 and 24, representing that the disabling detector 29 is exceeded by a speech sample and that speech is detected in the speech detector 7, results in prohibiting any adjustment to the speech and noise threshold levels. If the NAND gate 31 subsequently applies a binary 1 output to the preset input of the latch 33 and the output from the hangover one-shot 13, which is applied to the clear input of the latch, is active, representing a condition when speech is detected to be present but the speech samples fail to exceed the disabling threshold level, the latch will remain in the preset state and will continue to produce a binary 0 input until the hangover period is over or until the one-shot 13 becomes inactive. Consequently, the speech and noise threshold adjustments are disabled by the latch 33 for the entire duration of the speech burst even though portions of the speech burst may fall below the fixed threshold level of the disabling threshold detector 29.

If the one-shot 13 becomes inactive, either before or after the latch is preset by a binary 0 input from the output of the NAND gate 31, the output from the one-shot will cause the latch to provide a binary 1 output to the AND gates 23 and 24. Thus, the speech and noise threshold adjustments are enabled by the latch 33 when speech is not detected to be present in the communication channel.

From the foregoing, it will be apparent that the embodiments shown are only exemplary and that various modifications can be made in construction and arrangement within the scope of the invention as defined in the appended claims.

What is claimed is:

1. A digital voice switch for detecting speech signals in the presence of noise signals on a communication channel, where the signal in said channel is periodically sampled and encoded, comprising:

a. threshold adjustment means having sources of speech threshold signals and noise threshold signals and means for adjusting said speech and noise threshold signals;

b. speech detector means connected to receive said encoded signal samples and said speech threshold signal from said threshold adjustment means for comparing the magnitude of said samples with said speech threshold signal and for providing an output signal when said speech signals are determined to be present in said communication channel;

c. noise detector means connected to receive said encoded signal samples and said noise threaded signal from said threshold adjustment means for comparing the magnitude of said samples with said noise threshold signal and for providing an output signal developed from comparison of the magnitude of said encoded signal with said noise threshold signal indicating the level of said noise signals in said communications channel;

d. logic means connected to receive said output signal from said noise detector means and having a first state and a second state for applying command output signals to said threshold adjustment means when said logic means is in the first state and for not applying said command signals when said logic means is in the second state, said logic means being in the first state when the level of said noise signals exceeds a predetermined noise level or is less than a second predetermined noise level, and said command output signals causing said threshold adjustment means to adjust the values of said speech and noise threshold signals according to the level of said noise signals;

e. a source of a disabling threshold signal;

f. disabling detector means connected to receive said encoded signal samples and said disabling threshold signal from said source for providing an output signal when said encoded signal sample exceeds said disabling threshold signal; and g. disabling circuit means connected to receive said output from said disabling detector means and said output signal from said speech detector means for triggering said logic means to the second state when said sample exceeds said disabling threshold signal and when said output signal from said speech detector means indicates the presence of speech signals in said communication channel.

2. A digital voice switch as claimed in claim 1, wherein said logic means applies a first command output signal when the level of said noise signals exceeds said first predetermined noise level and a second command output signal when the level of noise signals is less than said second predetermined noise level.

3. A digital voice switch for detecting the presence of speech signals on a communication channel, where the signal in said channel is periodically sampled and encoded, comprising:

a. threshold adjustment means having sources of speech threshold signals and noise threshold signals and means for adjusting said speech and noise threshold signals;

b. speech threshold detector means having two inputs, one input connected to receive said encoded signal samples and the other input connected to receive said speech threshold signal from said threshold adjustment means, said speech threshold detector means providing a speech output signal indicating the presence of speech signals when said encoded signal samples exceed said speech threshold signal for a predetermined number of consecutive times over a predetermined period of time;

c. noise threshold detector means having two inputs, one input connected to receive said encoded signal samples and the other input connected to receive said noise threshold signal from said threshold adjustment means, said noise detector means providing a noise output signal indicating the presence of noise each time an encoded signal sample exceeds said noise threshold signal;

d. noise level measuring means connected to receive said noise output signal and having accumulator means for accumulating the number of times that encoded signal samples exceed said noise threshold signal over a predetermined period of time;

e. comparison means connected to receive said accumulated number from said noise level measuring means and having a source of first and second predetermined numbers for comparing the accumulated number with said first and second numbers, said comparison means providing a first output signal when said accumulated number exceeds said first number and a second output signal when said accumulated number is less than said second number;

f. a source of a signal representing a disabling threshold level;

g. disabling threshold detector means, connected to receive said encoded signal samples, said signal representing said disabling threshold level from said source, and said speech output signal from said speech threshold detector means, for providing a disabling signal when an encoded signal sample exceeds said signal representing said disabling threshold level and said speech output signal indicates the presence of speech signals in said communication channel and an enabling signal when said encoded signal sample is equal to or is less than said signal representing said disabling threshold level; and h. logic means, connected to receive said first and second output signals from said comparison means and said disabling and enabling signals from said disabling threshold detector means, for applying a first command output signal to said threshold adjustment means in response to the simultaneous presence of said first output signal and said enabling signal and a second command output signal to said threshold adjustment means in response to the simultaneous presence of said second output signal and said enabling signal, and for not applying either said first or second command output signals when said disabling signal is generated, said first command output signal causing said threshold adjustment means to increase the values of said speech and noise threshold signals by a predetermined increment value and said second command output signal causing said threshold adjustment means to decrease said threshold values by said predetermined increment value.

4. A digital voice switch as claimed in claim 3, wherein said speech threshold detector means further comprises a signal source having a fixed hangover time for producing said speech output signal, said speech output signal being connected to said disabling threshold detector means.

5. A digital voice switch as claimed in claim 4 further comprising a delay device connected to receive said encoded signal samples in said communication channel and a plurality of output gates connected to said delay means and connected to receive said speech output signal from said speech detector means, said output gates providing the passage of said encoded signal samples when said speech output signal is generated.

* * * * *